United States Patent [19]

Friedrich

[11] 4,137,749

[45] Feb. 6, 1979

[54] METALWORKING PRESS

[75] Inventor: Karl Friedrich, Remshalden-Geradstetten, Fed. Rep. of Germany

[73] Assignee: Textima AG, Zurich, Switzerland

[21] Appl. No.: 844,063

[22] Filed: Oct. 20, 1977

[30] Foreign Application Priority Data

Oct. 23, 1976 [DE] Fed. Rep. of Germany ..... 2648143
Aug. 18, 1977 [DE] Fed. Rep. of Germany ..... 2737231

[51] Int. Cl.[2] ..... B21J 9/18
[52] U.S. Cl. ..... 72/449; 72/450
[58] Field of Search ..... 72/450, 429, 449, 456, 72/452; 100/231, 282

[56] References Cited

U.S. PATENT DOCUMENTS

| | | | |
|---|---|---|---|
| 2,185,096 | 12/1939 | Treer | 100/282 |
| 2,378,062 | 6/1945 | Byerlein | 72/450 |
| 2,514,933 | 7/1950 | Byerlein | 100/231 |

*Primary Examiner*—C. W. Lanham
*Assistant Examiner*—Gene P. Crosby
*Attorney, Agent, or Firm*—Toren, McGeady and Stanger

[57] ABSTRACT

The press is of the type having a press housing and a press ram which can be moved backwards and forwards by means of two planetary gears. The planetary gears have two identical, coaxially arranged, fixed internal gear rims with an external gear arranged in each of them with a pitch diameter which is half the pitch circle of the internal gear. The housing is provided with a guide for the press ram. A bearing disc is connected to the external gear, has its bearing axis intersecting the contact point between the two pitch circles, and is at least indirectly pivotable in the ram. A driving gear is positioned coaxially to the internal gear rim. The improvement comprises that the driving gear is arranged between the two external gears mounted in pivotable manner in the driving gear and that a bearing for the driving gear is provided on the internal gear rim.

7 Claims, 9 Drawing Figures

METALWORKING PRESS

BACKGROUND OF THE INVENTION

The invention relates to a press, particularly for metal working. The press has a press housing, and a press ram which can be moved backwards and forwards by means of two planetary gears. The planetary gears have two identical, coaxially arranged, fixed internal gear rims. Arranged in each of them is an external gear with a pitch diameter which is half the pitch circle of the internal gear. A guide for the press ram is provided on the press housing. A bearing disc is connected to the external gear with the bearing axis intersecting the contact point between the two pitch circles. The bearing disc is at least indirectly pivotable in the ram and with a driving gear positioned coaxially to the internal gear rim.

A known press of the above type has two juxtaposed, interconnected planetary gears between which is located a ram and which can be driven by means of a laterally positioned driving gear. For the purpose of the joint driving of the two planetary gears, a transmission gear is necessary. This takes up additional space and causes additional costs.

SUMMARY OF THE INVENTION

The problem of the present invention is to obviate a connecting drive between two juxtaposed planetary gears, thereby ensuring a compact construction of the press.

According to the invention, this problem is solved in that the driving gear is arranged between the two external gears mounted in a pivotable manner in the driving gear. A bearing for the driving gear is provided on the internal gear rim.

Due to the arrangement of the driving gear between the two external gears, the driving gear can be used for pivoting the two external gears and can be mounted on projecting parts of the internal gear rims. This construction required no connecting drive and is extremely compact. In addition, only one guide is necessary.

In order to improve the safety of machine operators the upper inside of the internal gear rim can be made free from teeth in such a way that the external gear no longer rolls without slip on the internal gear. This can be achieved by a gap or a stop piece. As soon as the external gear meets the gap it is no longer driven so that the precisely perpendicular movement of the transmission member is disturbed, so that the latter pushes against its guide. When a stop piece is provided the external gear is stopped. In both cases, the automatic lowering of the transmission member and consequently the press ram is prevented with the driving gear rotating in the same direction.

An easy assembly and mounting of the shaft carrying the external gear, together with the bearings, can be achieved by making the gap a crescent-shaped recess, through which the external gear-carrying shaft, together with its bearings, can be introduced into the driving gear. A safety mechanism which is positioned in front of a safety mechanism for the operating personnel and which stops the transmission member from exceeding a particular stroke can be obtained by providing on the transmission member a stop member which co-operates with the outer periphery of the internal gear rim and limits the transmission member stroke. If the latter safety mechanism becomes inoperative, the first-mentioned safety mechanism comes into action.

DESCRIPTION OF THE PREFERRED EMBODIMENTS

Figure 1:
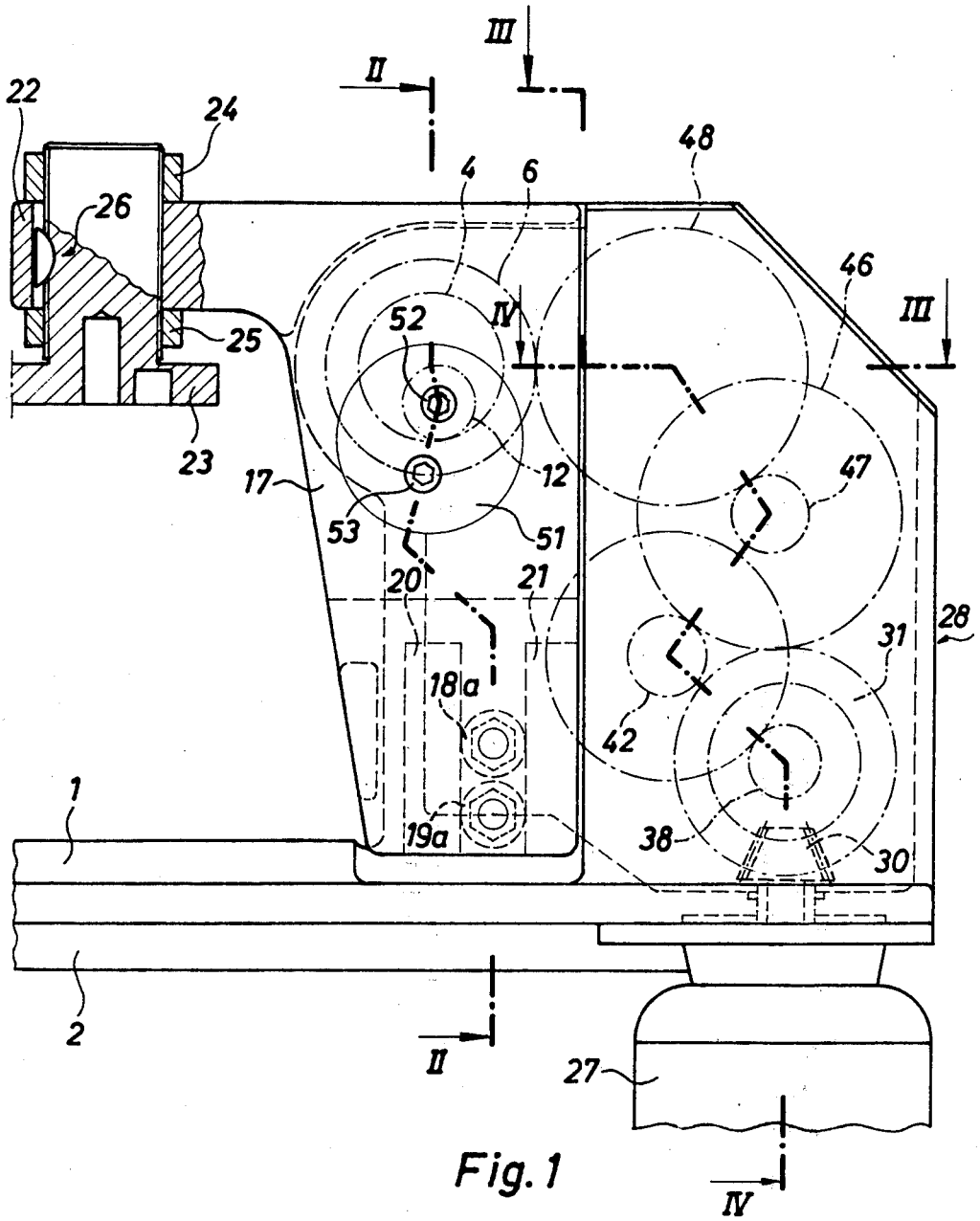
FIG. 1 is a partially schematic, partially phantom side view of a press in accordance with a preferred embodiment of the present invention.

The press shown in the drawings has a press table 1, constructed in one piece with a substantially L-shaped press housing 2, which is hollow in the area of its perpendicular leg 3. At the upper end of perpendicular leg 3 is fixed on either side of the cavity an internal gear rim 4 and **4*a*. The internal gear rims 4 and 4*a* are arranged in coaxial manner. Each of these gear rims has an inwardly projecting and also coaxially arranged bearing shoulder 5, 5*a*, whose bearing diameter is larger than the pitch diameter of the internal gear rim. Between the two bearing shoulders 5, 5*a* there is a spacing into which projects a driving gear 6 constructed as an external gear, whose gear blank 7 is mounted in the bearing shoulders 5, 5*a* by means of in each case one roller flange or bearing 8, 8*a***.

The gear blank 7 has an eccentrically arranged through-hole 9 in which is mounted a shaft 10 with the aid of five roller flanges or bearings 11, **11*a*, 11*b*, 11*c* and 11*d*. On each of the two ends of shaft 10 is mounted an external gear 12, 12*a* and a cam 13, 13*a*, whereby the outer ends of shaft 10 are formed by the two cams 13, 13*a*. The diameters of the external gears 12, 12*a* are somewhat smaller than the internal diameter of hole 9. The external gear 12 co-operates with the internal gear rim 4 and external gear 12*a* with internal gear rim 4*a*. The diameters of the pitch circles of the external gears 12, 12*a* are exactly half as large as the diameters of the pitch circles of the internal gear rims 4, 4*a*. Shaft 10, together with the external gears 12, 12*a* and cams 13, 13*a*** is constructed in one piece.

Cams 13 and **13*a* have in cross-section a non-circular shape. On cams 13 and 13*a* are mounted in non-rotatable manner two bearing discs 14 and 14*a*, whose axis passes through the point of contact between the pitch circles of the internal gear rims 4, 4*a* and the external gears 12, 12*a***.

Figure 2:
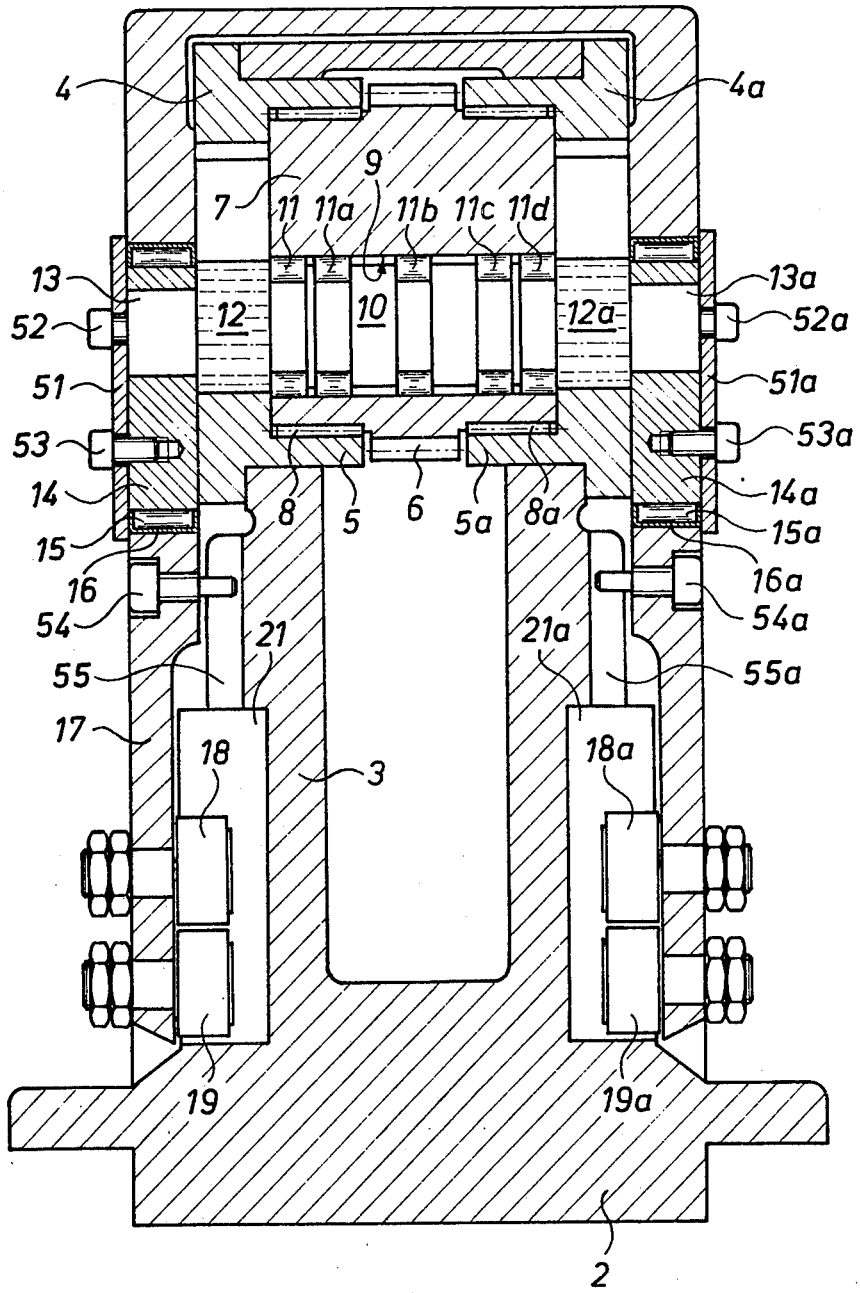
FIG. 2 is a sectional view of the press of FIG. 1 along the line II—II of FIG. 1 on a larger scale and with a partial omission.

Bearing discs 14, **14*a* are surrounded by a roller flange 15, 15*a*, located in a cross-sectionally U-shaped ring bearing 16, 16*a*. Ring bearings 16, 16*a* are positioned in a transmission member 17 which surrounds in U-shaped manner the perpendicular leg 3 of press housing 2 (FIG. 2). Two vertically superimposed guide rollers 18, 19, or 18*a*, 19*a*, whose bearings are fixed to transmission member 17, are provided on either side of the lower ends of the leg of transmission member 17. Guide roller pairs 18, 19 and 18*a*, 19*a* are arranged respectively between guide member pairs 20, 21** and 20a, 21a arranged perpendicularly on press housing 2 and serve for the perpendicular guidance of the transmission member 17 together with the planetary gears 6, 4, 12, 4a, 12a.

When viewed from the side, transmission member 17 is L-shaped. The longer leg surrounds the vertical leg of press housing 2 and the horizontally arranged shorter leg 22 carries a press ram 23 which is positioned perpendicularly above press table 1. Press ram 23 is placed in a hole in leg 22 and is held in its adjustable position by means of nuts 24, 25. A rotation preventing means 26 comprising a tongue and groove joint prevents a rotary movement of press ram 23 about its vertical axis.

Figure 4:
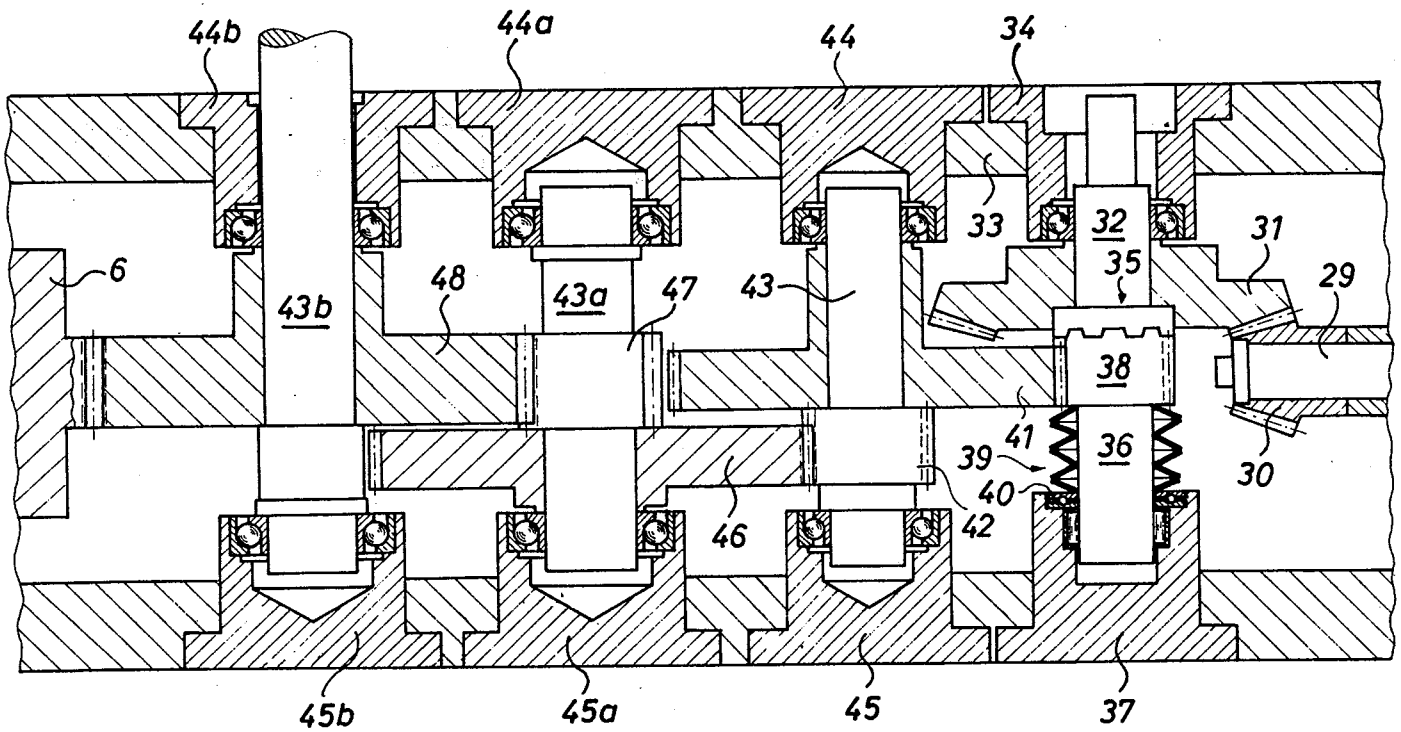
FIG. 4 is a section along the line IV—IV of FIG. 1 on a larger scale and with a partial omission.

Press ram 23 is driven by brake motor 27 which can be driven in two rotation directions and drives driving gear 6 by means of a gear 28 with a reduction ratio of approximately 1:100. On the driving shaft 29 of brake motor 27, not shown in FIG. 4, is mounted in a rotatable manner a bevel gear pinion 30 which meshes with a bevel gear 31. Bevel gear 31 is mounted in non-rotatable manner on a shaft 32 mounted by means of a ball bearing in a bearing flange 34 fitted in gear box 33. The end of shaft 32 es extended through bearing flange 34 and constructed for the application of a tool, so that shaft 32 can be turned for manually setting the press. Shaft 32 is connected via an overload clutch 35 with a shaft 36 arranged coaxially to shaft 32 and mounted in a bearing flange 37 by means of a roller bearing. Shaft 36 carries a pinion 38 which is connected in non-rotatable manner therewith. A set of plate springs 39 supported on one side on pinion 38 and on the other side on bearing flange 37 via an axial bearing 40 seeks to hold together the parts of the overload clutch which has meshing teeth with inclined butting surfaces. Shafts 32 and 36 are mounted within one another in not shown manner.

Figure 3:
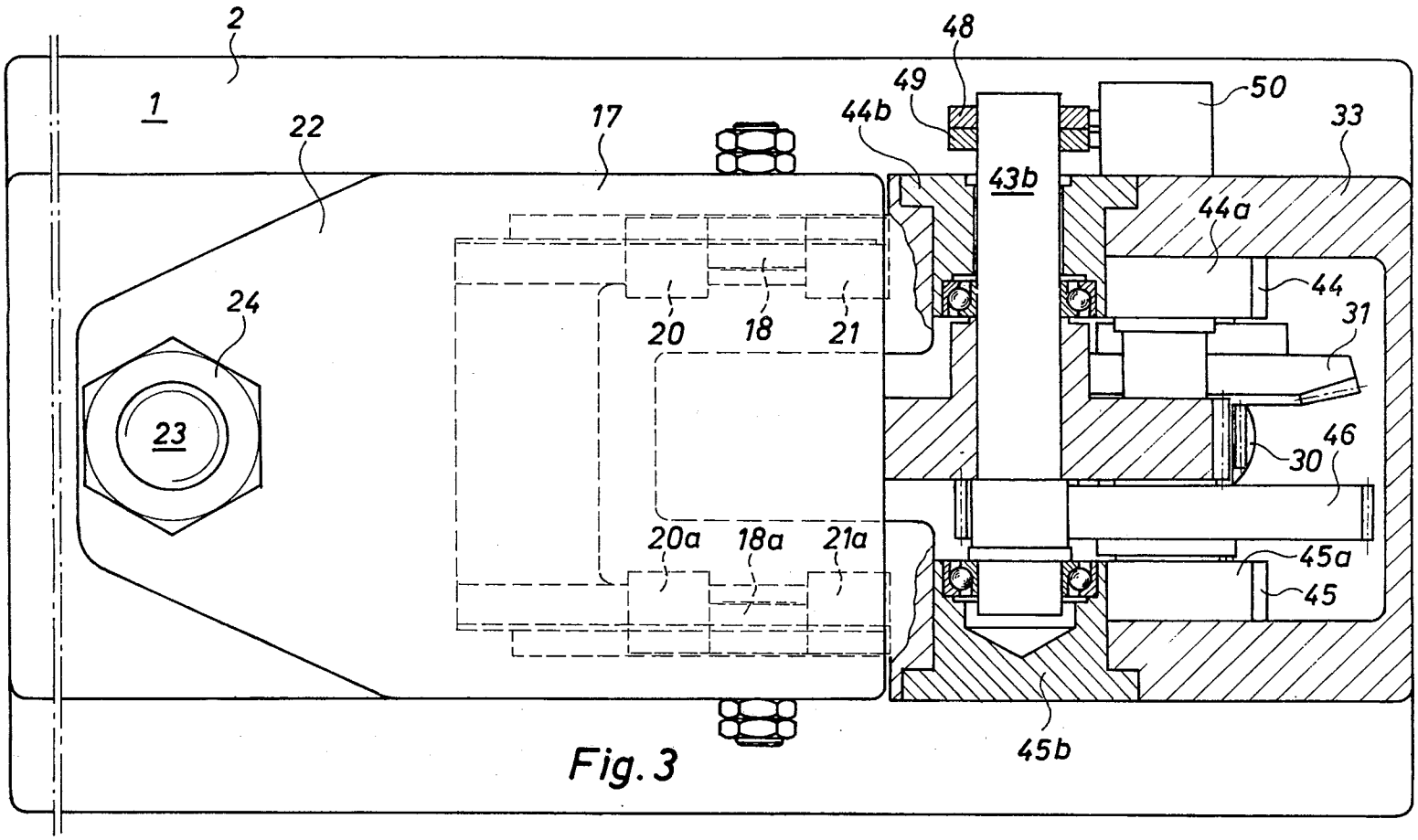
FIG. 3 is a partial section along the line III—III of FIG. 1 on a larger scale.

Pinion 38 meshes with a gear 41 which is connected in non-rotatable manner with a pinion 42, whose shaft 43 carries gear 41. Shaft 43 is mounted in bearing flanges 44, 45 provided on either side by means of ball bearings. Pinion 42 meshes with a gear 46 which is connected in non-rotatable manner with a pinion 47. Pinion 47 meshes with a gear 48 which in turn meshes with driving gear 6. Shaft 43a which carries gear 46 and pinion 47 and shaft 43b which carries gear 48 are mounted by means of ball bearings in bearing flanges 44a and 45a or 44b and 45b in the same way as shaft 43. Shaft 43b projects through bearing flange 44b and carries two adjusting collars 48, 49 (FIG. 3), whose projections co-operate with a limit switch 50.

Bearing disc 14 or 14a is covered by a cover plate 51 or 51a, which projects over ring bearing 16 or 16a. Cover plate 51 is connected by means of a screw 52 to cam 13 and by means of a screw 53 to bearing disc 14. Cover plate 51a is connected by means of a screw 52a to cam 13a and by means of a screw 53a to bearing disc 14a.

By means of gear 28, the driving gear 6 is driven by brake motor 27 at a speed of approximately 14 r.p.m. and rolls the external gears 12, 12a eccentrically mounted therein on the internal gear rims 4, 4a. As the pitch circle of internal gear rim 4, 4a is twice as large as the pitch circle of external gear 6 a point on the pitch circle of external gear 6, 6a describes a hypocycloid in the form of a straight line. The arrangement is such that this straight line runs parallel to the guide surfaces of guide members 20, 21. As the axis of bearing disc 4 passes through the contact point between the pitch circles of internal gear rim 4 or or 4a and external gear 6 or 6a, as shown in FIGS. 5 to 8 bearing disc 14 performs a straight, perpendicular movement and transmits this perpendicular movement to the transmission member 17 with the press ram 23 fitted thereto. A rotary movement of the transmission member about bearing disc 14 is prevented by guide rollers 18, 19 and 18a, 19a, arranged respectively between members 20, 21 and 20a, 21a.

If brake motor 27 is driven constantly, the press ram performs a stroke which corresponds to the pitch diameter of internal gear rims 4, 4a. A reduction of the stroke can be brought about by a corresponding adjustment of the adjustable collars 48, 49. If, after a predetermined adjustment, the press ram has performed the desired stroke e.g. adjustable collar 48 actuates limit switch 50, which reverses the rotation direction of brake motor 27, then the latter now drives the driving gear 6 in the opposite direction until adjustable collar 49 again actuates the limit switch 50, which again reverses the rotation direction of brake motor 27. If, for the purpose of reducing the stroke of ram 23, brake motor 27 is operated with a continuous rotation direction change, the external gears 12, 12a in each case pass through their bottom dead center.

Figure 5:
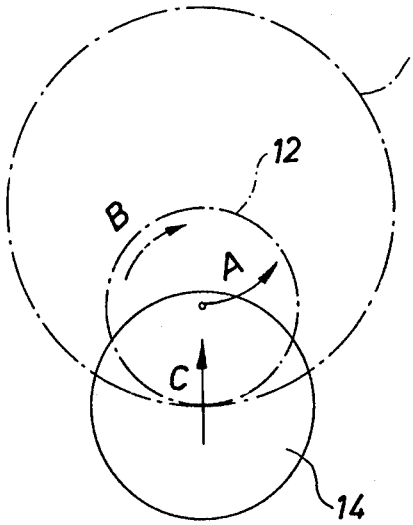
FIGS. 5–8 show the press of FIG. 1 in various operating positions.
Figure 6:
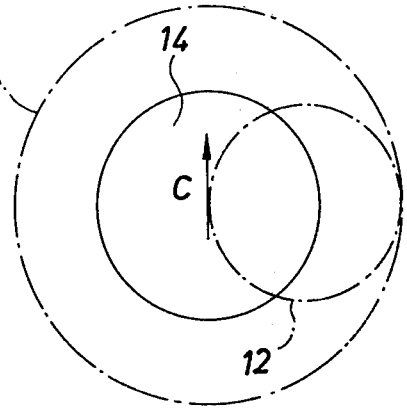
Figure 7:
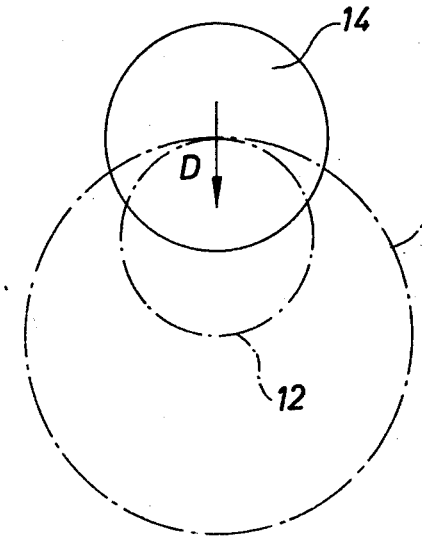
Figure 8:
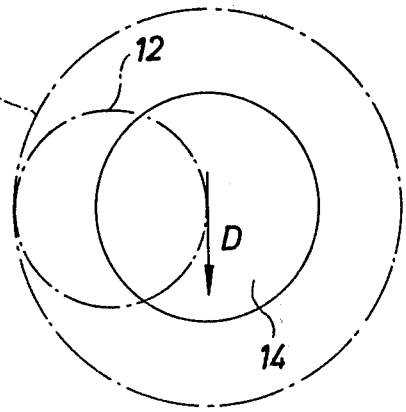

FIG. 5 shows the external gear 12 in its bottom dead center position, and FIG. 7 shows it in its top dead center position. In FIGS. 6 and 8 the external gear 12 is located in an intermediate position, whereby bearing disc 14 is located in the center of the pitch circle of internal gear rim 4. In FIG. 5, arrow A indicates the direction of movement of external gear 6 and arrow B its rotation direction on moving its rotation axis in the direction of arrow A. In FIGS. 5 and 6, arrow C indicates the movement of bearing disc 14 in one direction and in FIGS. 7 and 8 arrow D indicates its movement in the opposite direction.

Due to the use of the above-described planetary gear and the positioning of the ram in laterally displaced manner relative to the gear, a shallow, narrow construction of the press is obtained which, in the case of smaller presses, leads to such a limited overall height that the operator can supervise the press whilst remaining in the seated position.

The press can be used for working metal, wood, plastics or the like.

If limit switch 50 fails, inwardly projecting stop pins 54, 54a are screwed into the transmission member 17 below bearing discs 14, 14a and project into a vertical slot 55, 55a in leg 3 of press housing 2 and co-operate with the bottom of internal gear rim 4, 4a. In this case, stop pins 54, 54a are arranged in such a way that they strike against the bottom of internal gear rim 4 when limit switch 50 fails, before gears 12, 12a have reached the uppermost positions of internal gear rims 4, 4a.

Figure 9:
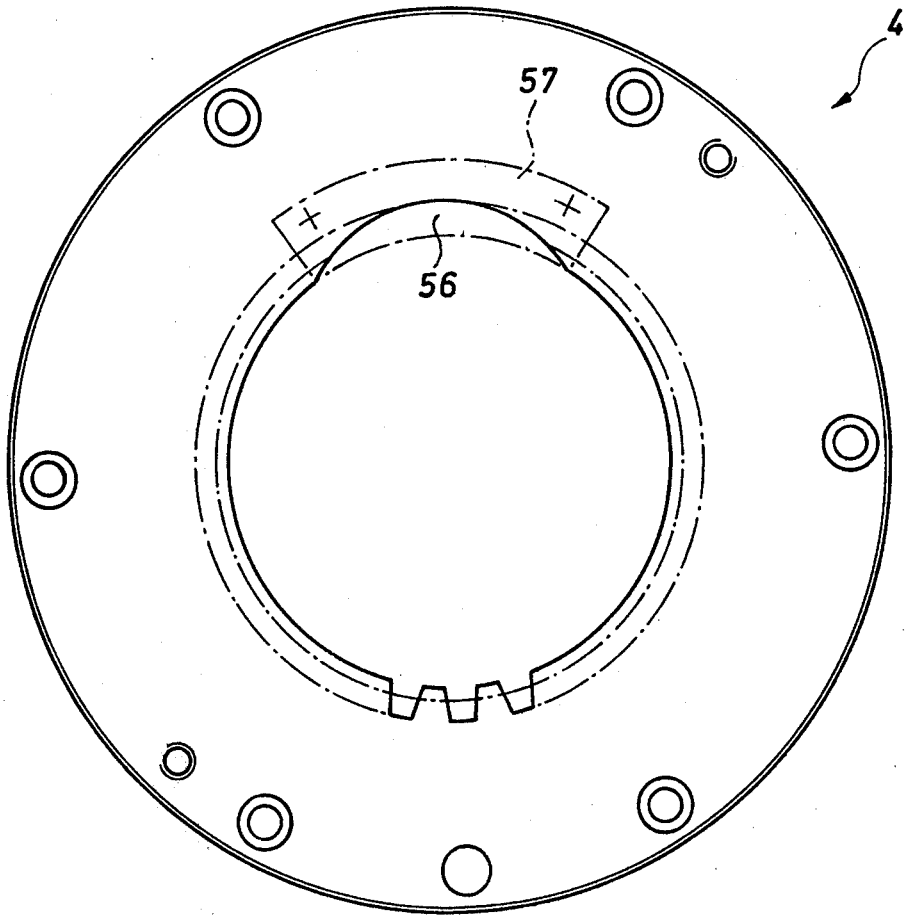
FIG. 9 is an individual plan view on a different scale of a part of the press of FIG. 1 shown only diagrammatically in FIG. 1.

Additional security against the exceeding of the uppermost positions in internal gear rims 4, 4a by the external gears 12, 12a is obtained through providing a gap 56 in the upper area of the teeth of both internal gear rims 4, 4a, where e.g. five teeth are missing and which in the view of FIG. 9 is limited by an arc. The diameter of this arc is selected in such a way that shaft 10 together with bearings 11 to 11d can be inserted from the side into driving gear 6.

If limit switch 50 is inoperative and stop pins 54, 54a break, external gears 12, 12a can almost reach their uppermost position within internal gear rim 4, 4a. However, just before reaching this position, engagement is prevented between internal gear rims 4, 4a and external gears 12, 12*a* due to the gap 56. The external gears then no longer roll without slip on the internal gear rims and the vertical guidance of transmission member 17 is no longer ensured. It thus exerts a pushing action, so that transmission member 17 stops. The press can be made operational again by resetting external gears 12, 12*a* relative to internal gear rims 4, 4*a*.

Instead of providing gap 56, no teeth need be provided on the upper insides of internal gear rims 4, 4*a*, so that instead of teeth and corresponding tooth gaps there can be a continuous raised zone against which the external gear 12, or 12*a* strikes, preventing any further movement thereof. In this case it is sufficient to drive the driving gear 6 in the opposite direction in order to render the press operational again. For safety, purposes before starting up the press again, stop pins 54, 54*a* must be replaced and the limit switch 50 must be repaired.

As shown by dotted lines in FIG. 9, the upper inside of the internal gear rim 4, which is not provided with teeth, can be replaced by a stop piece 57 which is detachably connected with the internal gear rim 4, 4*a* and forms a stop for external gear 12, 12*a*. With the stop piece removed, shaft 10, together with its bearings 11 to 11*d*, can be inserted into the driving gear 6 from the side.

I claim:

1. A metalworking press of the type having:

a press housing, a press ram which can be moved backwards and forwards by means of two planetary gears which have two identical, coaxially arranged, fixed internal gear rims with an external gear arranged in each of them with a pitch diameter which is half the pitch circle of the internal gear, a guide for the press ram provided on the press housing, a bearing disc connected to the external gear, with bearing axis intersecting the contact point between the two pitch circles, and which is at least indirectly pivotable in the ram, and a driving gear positioned coaxially to the internal gear rim, wherein the improvement comprises that the driving gear is arranged between the two external gears mounted in pivotable manner in the driving gear and that a bearing for the driving gear is provided on the internal gear rim.

2. A press according to claim 1, wherein on either side the driving gear has a bearing shoulder which co-operates with an associated bearing shoulder on the internal gear rim, the bearing shoulders of the internal gear rim being arranged on facing sides and wherein a bearing disc is arranged in the immediate vicinity of the side of the external gear remote from the driving gear.

3. A press according to claim 1, wherein the internal gear rim is free from teeth on its upper inside in such a way that the external gear can no longer roll without slip on the internal gear rim, and wherein a stop piece for stopping the external gear is provided in the pitch circle area in the tip of the internal gear rim.

4. A press according to claim 1, wherein a stop member co-operating with the outer periphery of the internal gear rim and which limits the stroke of the transmission member is provided on the latter.

5. A press according to claim 1, wherein the internal gear rim is free from teeth on its upper inside in such a way that the external gear can no longer roll without slip on the internal gear rim.

6. A press according to claim 5, wherein a gap which permits the automatic rotation of the external gear is provided on the top of the internal gear rim and prevents engagement between the internal gear rim and the external gear.

7. A press according to claim 6, wherein the gap is a crescent-shaped recess through which the shaft carrying the external gear together with its bearings can be inserted into the driving gear.

* * * * *